US011326587B2

(12) United States Patent
Lee et al.

(10) Patent No.: US 11,326,587 B2
(45) Date of Patent: May 10, 2022

(54) FLUID PUMP

(71) Applicant: Korea HyACT Intelligent Technology Co., Ltd., Anyang-si (KR)

(72) Inventors: Yong Kwun Lee, Anyang-si (KR); Young Soo Kim, Anyang-si (KR)

(73) Assignee: KOREA HYACT INTELLIGENT TECHNOLOGY CO., LTD., Anyang-si (KR)

( * ) Notice: Subject to any disclaimer, the term of this patent is extended or adjusted under 35 U.S.C. 154(b) by 50 days.

(21) Appl. No.: 16/889,888

(22) Filed: Jun. 2, 2020

(65) Prior Publication Data

US 2020/0392948 A1 Dec. 17, 2020

(30) Foreign Application Priority Data

Jun. 14, 2019 (KR) ..... 10-2019-0070882

(51) Int. Cl.
*F04B 1/124* (2020.01)
*F04B 45/02* (2006.01)
*F04B 1/2014* (2020.01)

(52) U.S. Cl.
CPC ..... *F04B 45/022* (2013.01); *F04B 1/124* (2013.01); *F04B 1/2014* (2013.01)

(58) Field of Classification Search
CPC ..... F04B 1/00–34; F04B 45/02–024; F04B 53/14; F04B 53/20; F04B 53/124; F04B 53/143; F04B 53/166–168; F04B 53/2014; F16J 3/00–06; F15B 15/1447–1452
See application file for complete search history.

(56) References Cited

U.S. PATENT DOCUMENTS 2,809,868 A * 10/1957 Thompson ..... F02M 57/02 239/93
2,856,857 A * 10/1958 Saalfrank ..... F04B 43/067 417/385
2,889,781 A * 6/1959 Thompson ..... F04B 1/14 92/37
3,894,395 A * 7/1975 Laing ..... F01K 3/10 60/652
4,187,173 A * 2/1980 Keefer ..... F04B 11/0083 210/652
4,305,211 A * 12/1981 Peterson ..... D06F 58/06 34/92

(Continued)

FOREIGN PATENT DOCUMENTS

FR 3003314 A1 * 9/2014 ..... F04B 1/122
JP 60-256570 A 12/1985

(Continued)

*Primary Examiner* — Devon C Kramer
*Assistant Examiner* — Thomas Fink
(74) *Attorney, Agent, or Firm* — Novick, Kim & Lee, PLLC; Jae Youn Kim

(57) ABSTRACT

A fluid pump is proposed. The fluid pump includes: a housing having an operation space and having connection ports disposed at a side in the operation space to discharge working fluid and suctioning working fluid from the outside; a swash plate coupled to the housing at an opposite side to the connection ports and having an inclined surface on a top facing the operation space; a cylinder block disposed in the operation space to be rotated by a driving shaft and having several cylinder rooms therein that extend in parallel with the driving shaft.

6 Claims, 8 Drawing Sheets

(56) References Cited

U.S. PATENT DOCUMENTS

| | | | | | |
|---|---|---|---|---|---|
| 4,615,257 | A * | 10/1986 | Valentin | F04B 1/2071 91/487 |
| 4,723,894 | A * | 2/1988 | Marx | F04B 45/022 417/269 |
| 4,984,970 | A * | 1/1991 | Eickmann | F04B 43/067 417/271 |
| 2008/0008605 | A1* | 1/2008 | Bauer | F04B 43/107 417/375 |
| 2010/0209269 | A1* | 8/2010 | Solera | F04B 53/143 417/415 |
| 2019/0032685 | A1* | 1/2019 | Foster | F04B 1/053 |
| 2020/0003197 | A1* | 1/2020 | Colavincenzo | F04B 35/01 |

FOREIGN PATENT DOCUMENTS

| | | | | |
|---|---|---|---|---|
| JP | 05231301 | A | 9/1993 | |
| JP | 3710174 | B2 | 10/2005 | |
| JP | 2018-135773 | A | 8/2018 | |
| KR | 10-1999-0020034 | A | 3/1999 | |
| KR | 19990020034 | A * | 3/1999 | F04B 1/122 |
| KR | 10-2006-0060168 | A | 6/2006 | |
| KR | 10-2012-0126134 | A | 11/2012 | |

* cited by examiner

FLUID PUMP

CROSS REFERENCE TO RELATED APPLICATION

The present application claims priority to Korean Patent Application No. 10-2019-0070882, filed Jun. 14, 2019, the entire contents of which is incorporated herein for all purposes by this reference.

BACKGROUND OF THE INVENTION

Field of the Invention

The present invention relates to a fluid pump and, more particularly, to a fluid pump without a retainer connecting a swash plate and a piston to each other.

Description of the Related Art

A common fluid pump, for example, a hydraulic pump uses the phenomenon in which the phase changes when a swash plate having an inclined surface is rotated. According to the brief structure, a piston that generates hydraulic pressure by moving straight in a cylinder is connected to a retainer through a piston shoe. The retainer, which retains the piston shoe, is in contact with the swash plate, so the piston can be in close contact with the swash plate. In this configuration, the retainer is connected to the cylinder through the piston, so the retainer is also rotated in a housing.

The retainer is disposed between the swash plate and the piston shoe in such an existing hydraulic pump, so the retainer can transmit the force of the inclined surface of the swash plate pushing or pulling the piston to the piston. For example, since the piston disposed in the cylinder is connected to the retainer through the piston shoe, the piston can be pulled by the retainer when the retainer is rotated along the inclined surface of the swash plate. In more accurately, the piston can be pulled downward, that is, toward the swash plate by the retainer when the piston moves from the top dead center to the bottom dead center while rotating with the retainer.

However, there is a problem that the number of the parts of the entire pump, the number of assembly processes, and the weight of the entire pump are increased by the retainer and the piston shoe. In particular, the retainer and the piston shoe need to be assembled, the piston and the piston shoe need to be assembled, and precise work is required for the assembling, so automation is difficult, and accordingly, there is a problem that the manufacturing cost is further increased.

Further, the piston shoe needs to be fitted to the retainer, and to this end, any one of them should be made of an elastic material or it is required to divide the retainer into several parts and fit the piston shoe therebetween, which makes it more difficult to manufacture the pump.

A large load is applied to the joint between the retainer and the piston shoe when the piston is pulled from the cylinder toward the swash plate, so, in this process, there is a problem that the retainer and the piston shoe may be worn, or torn, if severe, and the efficiency of the pump decreases due to excessive separation force.

Further, working fluid leaks through the gap between the piston and the cylinder in some time in the hydraulic pumps of the related art, so it is required to install a separate sealing member between the piston and the cylinder in order to prevent the leakage. Installing a sealing member for every piston not only increases the number of parts, but also makes it difficult to downsize a pump.

Documents of Related Art (Patent Document 1) Korean Patent Application Publication No. 10-2012-0126134

(Patent Document 2) Korean Patent Application Publication No. 10-2006-0060168

SUMMARY OF THE INVENTION

The present invention has been made in an effort to solve the problems in the related art and an objective of the present invention is to directly bring a piston in close contact with a swash plate using an elastic member without a retainer connecting the piston and the swash plate.

Another objective of the present invention is to prevent leakage of working fluid by giving a sealing function to an elastic member coupled to a piston.

In order to achieve the objectives, a fluid pump according to an aspect of the present invention includes: a housing having an operation space and having connection ports disposed at a side in the operation space to discharge working fluid and suctioning working fluid from the outside; a swash plate coupled to the housing at an opposite side to the connection ports and having an inclined surface on a top facing the operation space; a cylinder block disposed in the operation space to be rotated by a driving shaft and having several cylinder rooms therein that extend in parallel with the driving shaft; piston units inserted at least partially in the cylinder rooms to revolve with the cylinder block and compressing or suctioning working fluid while moving up and down on the inclined surface of the swash plate with one protruding end thereof in contact with the inclined surface of the swash plate; and elastic members coupled to upper portions of the piston units that face the connection ports, and elastically supporting the piston units toward the swash plate.

The elastic member may have a fluid space having an end being open toward the connection ports, may be compressed to reduce volumes of the fluid space when the piston unit is moved up on the swash plate, and may be elastically restored to increase the volume of the fluid space when the piston unit is moved down on the swash plate.

The elastic member may have prominences and depressions on an outer surface and the prominences and depressions may be continuously formed in a compression direction of the elastic member to form a corrugated pipe shape.

The piston unit may have a piston body extending in an up-down movement direction of the piston unit, and a piston ball having a curved outer shape and connected to an end of the piston body.

A coupling groove may be formed on a top of the piston body that is opposite to the piston ball, so a coupling protrusion of the elastic member is fitted therein or is in close contact.

The elastic member may have an upper end disposed at an upper portion facing the connection ports and having an inlet of the fluid space, a lower end disposed opposite to the upper end and being in close contact with the top of the piston body of the piston unit, and a compressive body connecting the upper and the lower end to each other and configured to change the volume of the fluid space in the elastic member by being compressed or restored.

An outer diameter of the upper end of the elastic member may be larger than or the same as an inner diameter of the cylinder room, so a side of the upper end may be in close contact with an inner side of the cylinder room, and an outer diameter of the compressive body of the elastic member may be smaller than the inner diameter of the cylinder room.

The upper end of the elastic member may have a predetermined height by extending in a longitudinal direction of the cylinder room.

The piston ball of the piston unit may be integrally formed with the piston body or a spherical piston ball may be coupled to the piston body.

The piston units may be respectively inserted in the cylinder rooms formed around a shaft-coupling groove formed at a center of the cylinder block and the cylinder rooms may be configured in several room layers arranged with different radii around the shaft-coupling groove.

The fluid pump according to the present invention described above has the following effects.

According to the fluid pump of the present invention, there is no retainer and no piston shoe for connecting a piston and swash plate and an elastic member elastically supports a piston toward a swash plate to keep the piston in contact with the swash plate. Since there is no retainer and no piston shoe, the number of parts and the number of assembly processes of the fluid pump are reduced and the manufacturing cost is decreased.

In particular, since there is no need for assembling a retainer and a piston shoe and assembling a piston and a piston shoe, which require precise work, according to the present invention, the fluid pump can be easily assembled and maintenance also becomes easy.

Further, since there is no assembly structure between a retainer and a piston shoe to which a large load is applied in operation, durability of the fluid pump increases.

Further, the elastic member elastically supporting the piston in the present invention has a fluid space therein and the other portion excluding the inlet of the fluid space is separated from a cylinder. That is, the elastic member itself prevents leakage of working fluid as a kind of sealing member, thereby being able to increase the durability of the product. In particular, the elastic member can efficiently perform the sealing function because of the characteristics of the material thereof having elasticity.

Further, since there is no retainer and no piston shoe in the present invention, the entire size and the weight of the fluid pump are reduced. There is also an advantage that the fluid pump can be used for various fields and uses such as toys and small robots through the downsizing and light-reduction.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
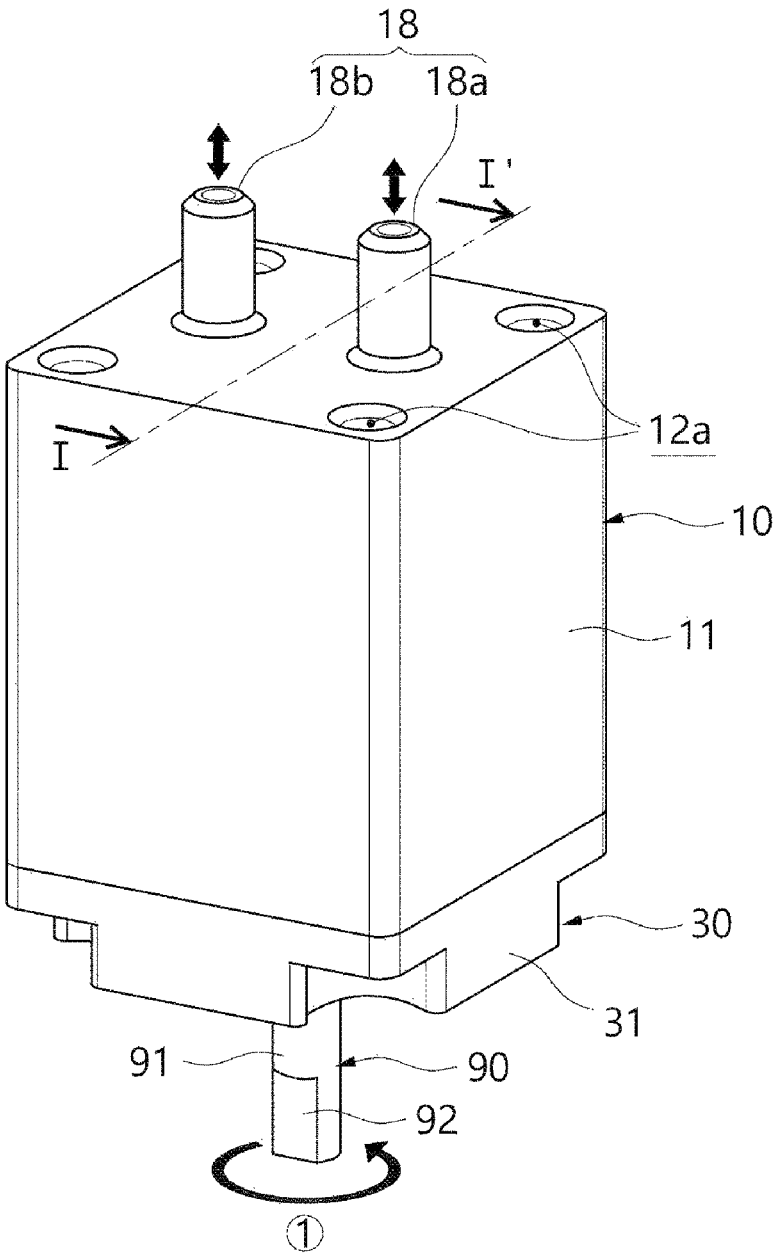
FIG. 1 is a perspective view showing the external appearance of an embodiment of a hydraulic pump according to the present invention.

Hereinafter, some embodiments of the present invention are described in detail with exemplary drawings. It should be noted that when components are given reference numerals in the drawings, the same components are given the same reference numerals even if they are shown in different drawings. In the following description of embodiments of the present invention, when detailed description of well-known configurations or functions is determined as interfering with understanding of the embodiments of the present invention, they are not described in detail.

Terms "first", "second", "A", "B", "(a)", and "(b)" can be used in the following description of the components of embodiments of the present invention. The terms are provided only for discriminating components from other components and, the essence, sequence, or order of the components are not limited by the terms. When a component is described as being "connected", "combined", or "coupled" with another component, it should be understood that the component may be connected or coupled to another component directly or with another component interposed therebetween.

The present invention relates to a fluid pump that rotates a driving shaft 90 using a motor, an engine, or the like and generates hydraulic pressure or water pressure by converting torque of the driving shaft 90 into translation. In particular, according to the present invention, a piston unit 70 is operated directly in close contact with a swash plate 40 without a retainer connecting the swash plate 40 and the piston unit 70 to each other. The piston unit 70 is elastically supported toward the swash plate 40 by an elastic member 80, thereby being able to keep the piston unit 70 in close contact with the swash plate 40 on a bottom dead surface 41*b*. For reference, working fluid may be various kinds of fluid such as water or oil in the present invention, but water is exemplified in the following description.

Referring to FIG. 1, a housing 10, 30 form the frame of the present invention. The housing 10, 30 has a substantially cylindrical shape and has an operation space 13 therein. The housing 10, 30 may be considered as being composed of two parts, and in this embodiment, the housing 10, 30 is composed of a first housing 10 and a second housing 30. When the first housing 10 and the second housing 30 are combined, the sealed operation space 13 is defined therein. The operation space 13 has a substantially cylindrical shape and a cylinder block 40 is inserted therein. The second housing 30 may be considered as a kind of cover. In this embodiment, the swash plate 40 to be described below is integrally formed with the second housing 30.

Figure 2:
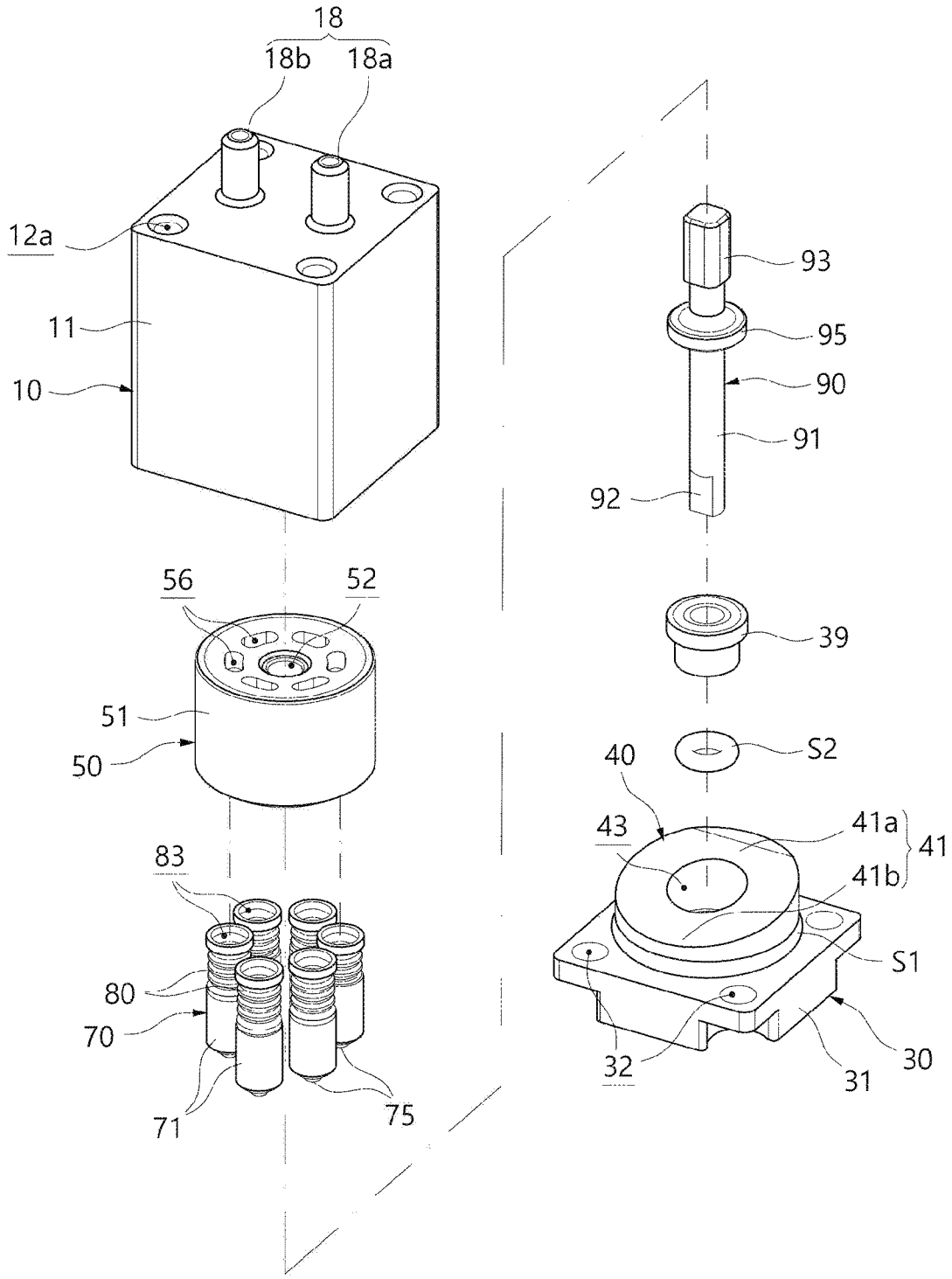
FIG. 2 is an exploded perspective view showing the parts of an embodiment of a hydraulic pump according to the present invention.
Figure 3:
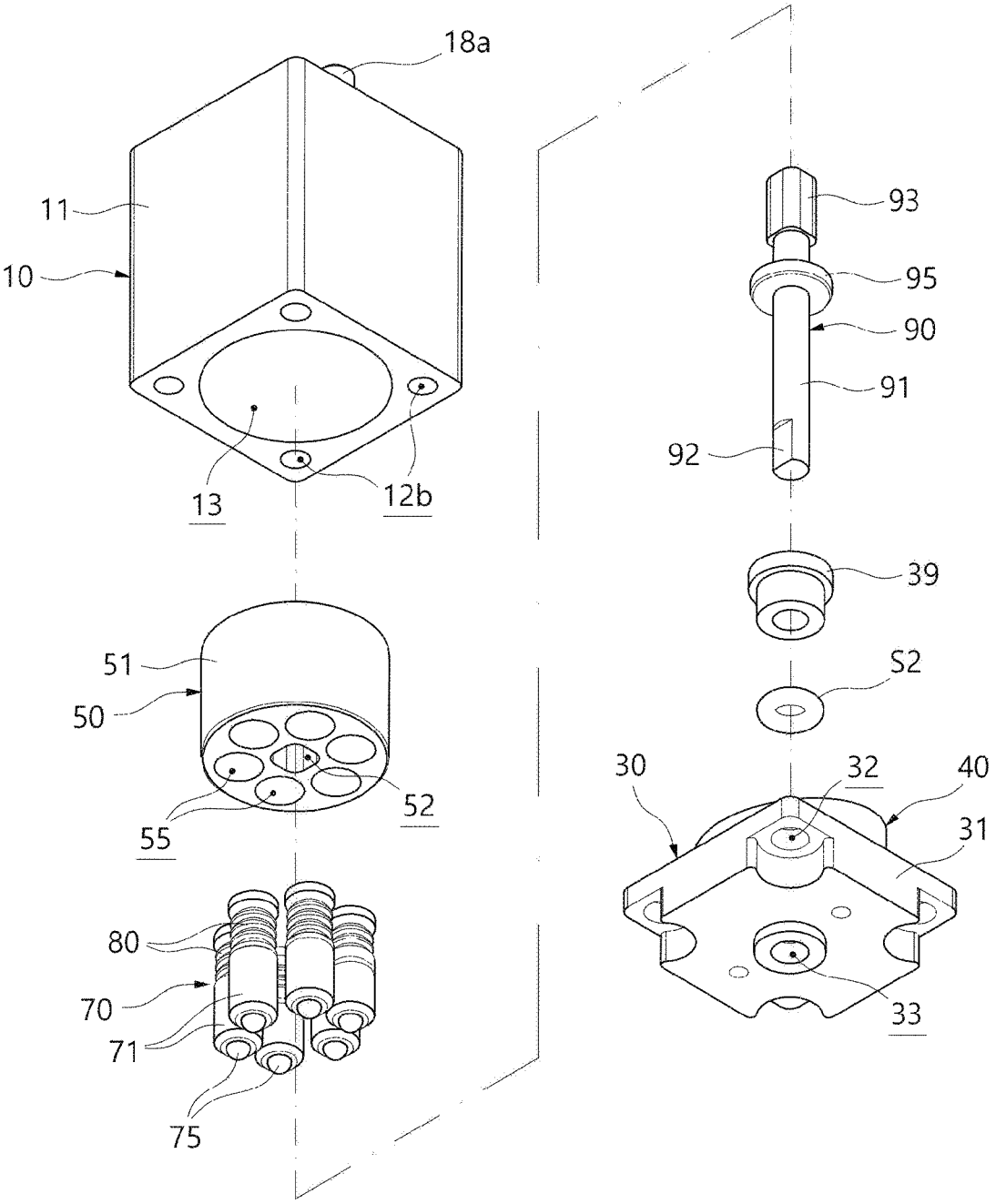
FIG. 3 is a perspective view showing the embodiment of FIG. 2 at another angle.

Referring to FIGS. 2 and 3 to describe the first housing 10, several first fastening holes 12*a* and 12*b* for coupling through fasteners are formed in a body 11 of the first housing 10, in which some of the fastening holes are formed through the top of the body 11 and some are formed through the bottom of the body 11. The operation space 13 is open downward from the first housing 10. Although the operation space 13 is open downward, it becomes a closed empty space when the second housing 30 is coupled to the first housing 10.

Connection ports 18 are disposed on the top of the first housing 10. The connection ports 18 are inlet and outlet through which working fluid flows inside from the outside or fluid compressed in the operation space 13 is discharged. The connection ports 18 are provided in a pair, that is, a first port 18*a* and a second port 18*b* are disposed in parallel. The first port 18*a* and the second port 18*b* are both open outward from the fluid pump and may be connected to an external apparatus, such as a manipulator (not shown) or a fluid reservoir (not shown). For example, if compressed working fluid is discharged through the first port 18*a*, working fluid can flow inside from the outside through the second port 18*b*. Obviously, when a motor is rotated in the opposite direction, working fluid may flow inside from the outside through the first port 18*a* and compressed working fluid may be discharged through the second port 18*b*.

Though not shown in the drawings, a connection groove is formed on an inner side corresponding to the ceiling of the operation space 13. The connection groove is provided in a pair, so one of them is connected to the first port 18*a* and the other one is connected to the second port 18*b*. The connection grooves are connected to entrances 56 of the cylinder block 50. Accordingly, one of the pair of connection grooves receives working fluid compressed by the piston unit 70 and sends it to the first port 18*a* (or the second port 18*b*) and the other one receives working fluid flowing inside through the second port 18*b* (or the first port 18*a*) and sends it into the cylinder room 55.

The second housing 30 is coupled to the bottom of the first housing 10. The second housing 30 formed in a shape corresponding to the bottom of the first housing 10 and closes the operation space 13. The body 31 of the second housing 30 has a substantially rectangular frame shape and has several second fastening holes 32 formed around the edge, so the second fastening holes 32 can be fastened to the first fastening holes 12*b* of the first housing 10 by fasteners. A center hole 33 is formed at the center of the second housing 30 and a portion of the driving shaft 90 passes through the center hole 33. The end portion of the driving shaft 90 passing through the center hole 33 is connected to a motor (not shown), so the driving shaft 90 can be rotated.

The swash plate 40 is disposed on the top of the second housing 30. The swash plate 40, which is a part lifting the piston unit, is inclined in one direction. The swash plate 40 may be integrally formed with the second housing 30 or may be separately formed and then coupled to the second housing 30. In this embodiment, the swash plate 40 is integrally formed with the second housing 30. In this embodiment, the first housing 10 and the second housing 30 are both made of synthetic resin through injection molding. Accordingly, the swash plate 40 can be easily integrally formed with the second housing 30. Obviously, the first housing 10, the second housing 30, and the swash plate 40 may be made of metal or may be made of other materials through double injection molding. Reference numeral 'S1' indicates a first sealing member, which prevents working fluid from leaking between the first housing 10 and the second housing 30.

The swash plate 40 is coupled to the first housing 10 at the opposite side to the connection ports 18 and has an inclined surface 41 on the top facing the operation space 13. The inclined surface 41 has a shape of which one side gradually increases in height when the swash plate 40 is seen from a side, but has a substantially ring shape when seen from above. The inclined surface 41 may be divided into a top dead surface 41*a* that is highest and a bottom dead surface 41*b* that is lowest. When the piston unit 70 is positioned on the top dead surface 41*a*, it compresses working fluid while moving up out of the cylinder room 55, and when it is positioned on the bottom dead surface 41*b*, it suctions working fluid into the cylinder room 55. Reference numeral '43' is a through-hole connected to the center hole 33 and the driving shaft passes through the through-hole.

A fastening block 39 is inserted in the through-hole 43 and a second sealing member S2 is disposed ahead of the fastening block 39 and prevents working fluid from leaking through the center hole 33. The fastening block 39 is pressed down by a flange 95 of the driving shaft to be described below.

Next, the cylinder block 50 is described. A body 51 of the cylinder block 50 has a substantially cylindrical shape and has a plurality of cylinder rooms 55 formed in the up-down direction, that is, in parallel with the driving shaft 90. The piston unit 70 is disposed in each of the cylinder rooms 55. The cylinder block 50 is connected to the driving shaft 90 and rotated together and is slightly spaced apart from the swash plate 40. That is, the cylinder block 50 is disposed in the operation space 13 and the inclined surface 41, which faces the bottom of the operation space 13, of the swash plate 40 is spaced apart from the cylinder block 50.

A shaft-coupling groove 52 is formed at the center of the cylinder block 50 and a coupling head 93 of the driving shaft 90 is inserted in the shaft-coupling groove 52. The shaft-coupling groove 52 has not a circular, but a polygonal transverse cross-section, so the coupling head 93 can be rotated together without idling. Several cylinder rooms 55 are formed around the shaft-coupling groove 52 and a total of six cylinder rooms 55 are formed in this embodiment. Obviously, the number of the cylinder room is not limited. For example, the cylinder rooms 55 may be configured in several room layers arranged with different radii around the shaft-coupling groove 52.

Referring to FIG. 2, the cylinder block 50 has entrances 56. The entrances 56 are portions being open upward and are connected to the connection grooves described above. Accordingly, the compressed working fluid discharged from a cylinder room 55 through an entrance 56 of the cylinder block 50 is discharged through the first port 18*a*, and the working fluid flowing inside through the second port 18*b* from the outside is suctioned into another cylinder room 55 through an entrance 56.

The piston units 70 are disposed in the cylinder rooms 55. The piston units 70 are inserted in the cylinder rooms 55, and are rotated with the cylinder block 50 while moving up/down in the cylinder rooms 55. In more accurately, the piston units 70 are at least partially inserted in the cylinder rooms 55, and when the piston units 70 are rotated with the cylinder block 50, protruding ends thereof come in contact with the inclined surface 41 of the swash plate 40 and moves up/down on the inclined surface 41 of the swash plate 40, thereby compressing or suctioning working fluid.

Figure 4:
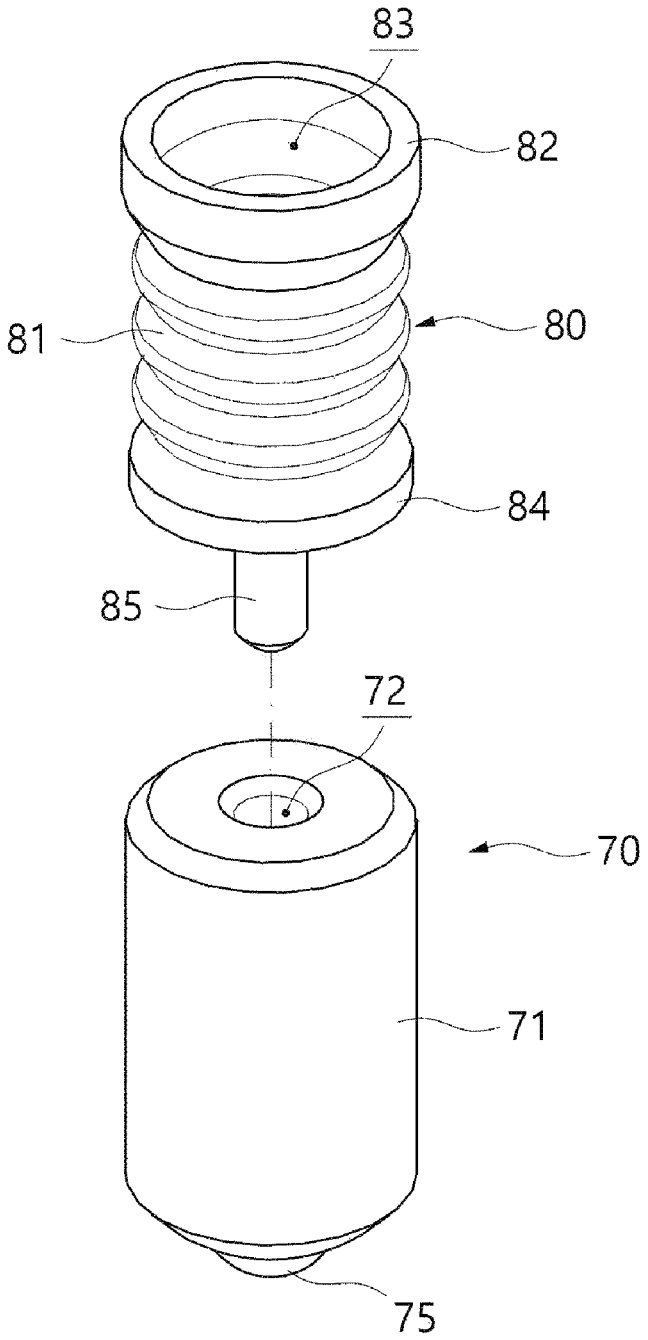
FIG. 4 is an exploded perspective view showing a piston unit and an elastic member of the embodiment of FIG. 2.

In detail, the piston units 70 each have a piston body 71 extending in the lifting direction and a piston ball 75 having a curved outer surface and connected to an end of the piston body 71 facing the swash plate 40. The piston body 71 has a cylindrical shape corresponding to the cylinder room 55 and is inserted in the cylinder room 55. The piston ball 75 is a part that is supported in contact with the inclined surface 41 of the swash plate 40. The piston ball 75 may be integrally formed with the piston body 75 or a spherical piston ball may be coupled to the piston body 71, but the piston ball 75 is exemplified as a separate part in this embodiment. The piston ball 75 is a part that is easily worn, so it may be made of a material having hardness higher than the piston body 71 for high wear resistance. Referring to FIG. 4, a coupling groove 72 is formed on the top of the piston body 71 and a coupling protrusion 85 of the elastic member 80 to be described below may be fitted in the coupling groove 72.

The piston ball 75 of the piston unit 70 is in contact with the inclined surface 41 of the swash plate 40, but the piston unit 70 is not directly coupled to the swash plate 40. Accordingly, when the piston unit 70 faces the bottom dead surface 41*b* of the inclined surface 41 of the swash plate 40, the piston unit 70 can be remained in the cylinder room 55 without protruding downward, that is, toward the inclined surface 41 from the cylinder room 70. The elastic member 80 is used to push the piston unit 70 toward the swash plate 40. The elastic member 80 is coupled to the top of the piston unit 70 that faces the connection port 18 and elastically supports the piston unit 70 toward the swash plate 40.

Figure 5:
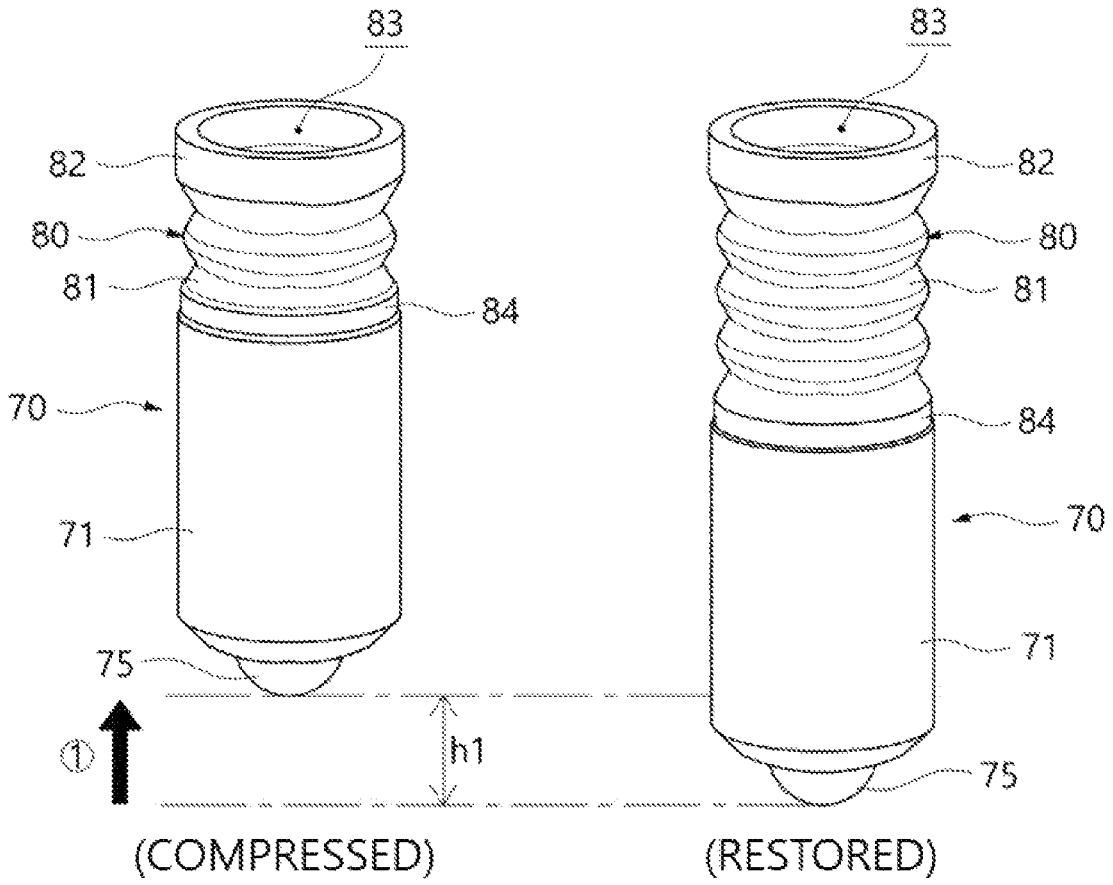
FIG. 5 is a perspective view showing the states in which the elastic member is compressed and restored in the embodiment of FIG. 2.

A detailed shape of the elastic member 80 is shown in FIG. 4. The elastic member 80 itself is made of an elastic material, for example, silicon, synthetic resin of a flexible material, natural rubber, synthetic rubber, or a mixture thereof. The elastic member 80 has a substantially cylindrical shape and has a fluid space 83 therein having one side open toward the connection port 18. When the piston unit 70 moves up on the inclined surface 41 of the swash plate 40, the elastic member 80 is compressed such that the volume of the fluid space 83 is decreased, and when the piston unit 70 moves down on the inclined surface 41 of the swash plate 40, the elastic member 80 is elastically restored such that the fluid space 83 is increased. FIG. 5 shows the compressed state and the restored state of the elastic member 80, in which the height different between the two states is indicated by 'h1'.

In this embodiment, the elastic member 80 has prominences and depressions on the outer surface. The prominences and recession are sequentially arranged in the compression direction of the elastic member 80, thereby forming a corrugated pipe shape. Accordingly, when the elastic member 80 is compressed, the corrugated pipe is deformed such that the gaps between the prominences and recessions decrease.

The structure of the elastic member 80 is described in detail. The elastic member 80 may be divided into an upper end 82, a lower end 84, and a compressive body 81. The upper end 82 is a portion that formed on the top facing the connection port 18 and at which an inlet of the fluid space 83 is formed, and the lower end 84 is a portion that is positioned opposite to the upper end 82 and is in close contact with the top of the piston body 71 of the piston unit 70. The coupling protrusion 85 is disposed at the lower end 84 and is fitted in the coupling groove 72 of the piston body 71. Accordingly, the elastic member 80 and the piston unit 70 can be in close contact with each other. However, the elastic member 80 and the piston unit 70 may be simply in contact with each other without the coupling protrusion 85 and the coupling groove 72.

The compressive body 81 is a part that connects the upper end 82 and the lower end 82 and changes the volume of the fluid space 83 in the elastic member 80 by being compressed or restored. It may be considered that the fluid space 83 is inside the compressive body 81.

Figure 7:
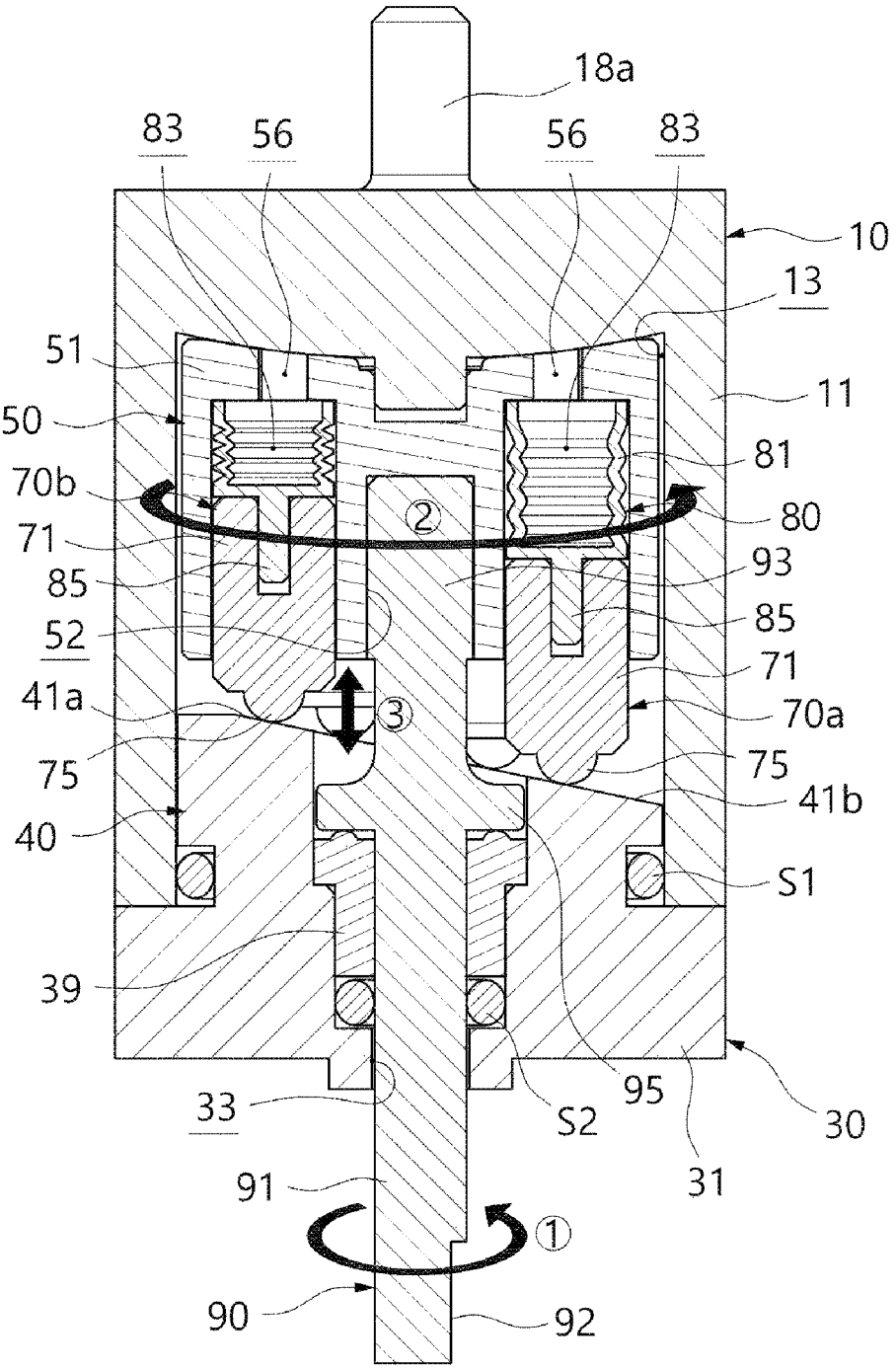
FIG. 7 is a cross-sectional view taken along line I-I' of FIG. 1.

The outer diameter of the upper end 82 of the elastic member 80 is larger than or the same as the inner diameter of the cylinder room 55, so the side of the upper end 82 is in close contact with the inner side of the cylinder room 55. This is for preventing leakage of working fluid by operating the elastic member 80 itself as a kind of sealing member, thereby remaining the working fluid only in the fluid space 83. Accordingly, it is possible to increase not only durability, but also operational reliability and compression efficiency. Referring to FIG. 7, it can be seen that the upper end 82 of the elastic member 80 has a predetermined height by extending in the longitudinal direction of the cylinder room 55 to improve the sealing function and guide a compressive direction.

However, the compressive body 81 of the elastic member 80 may have an outer diameter smaller than the inner diameter of the cylinder room 55 so that the prominences and depressions of the compressive body 81 can be as easily compressed as possible without interference with the inner side of the cylinder room 55 in the compression process.

Meanwhile, though not shown in the drawings, the elastic member 80 may have a cylindrical shape without a prominence and depression. Even in this case, the elastic member 80 can be compressed/restored by the material thereof itself. Alternatively, even if there are prominences and depressions, they may be formed diagonally or in the longitudinal direction of the elastic member 80. For reference, although the piston unit 70 and the elastic member 80 are discriminated in the above description, but the elastic member 80 may be considered as a portion of the piston unit 70.

Finally, the driving shaft 90 is described. A driving-coupling portion 92 formed at an end portion of the shaft body 91 is coupled to a drive (not shown) such as a motor, whereby the driving shaft 90 receives torque. Further, a coupling head 93 at another end portion is coupled to the cylinder block 50, thereby transmitting torque from the driver to the cylinder block 50. As shown in FIG. 1, when the driving shaft 90 is coupled to the fluid pump, the driving-coupling portion 92 protrudes out of the second housing 30. Reference numeral '95' presses a separate fastening block 39 in a sealing direction S2.

The operation of an embodiment of the present invention is described hereafter with reference to the drawings.

Figure 6:
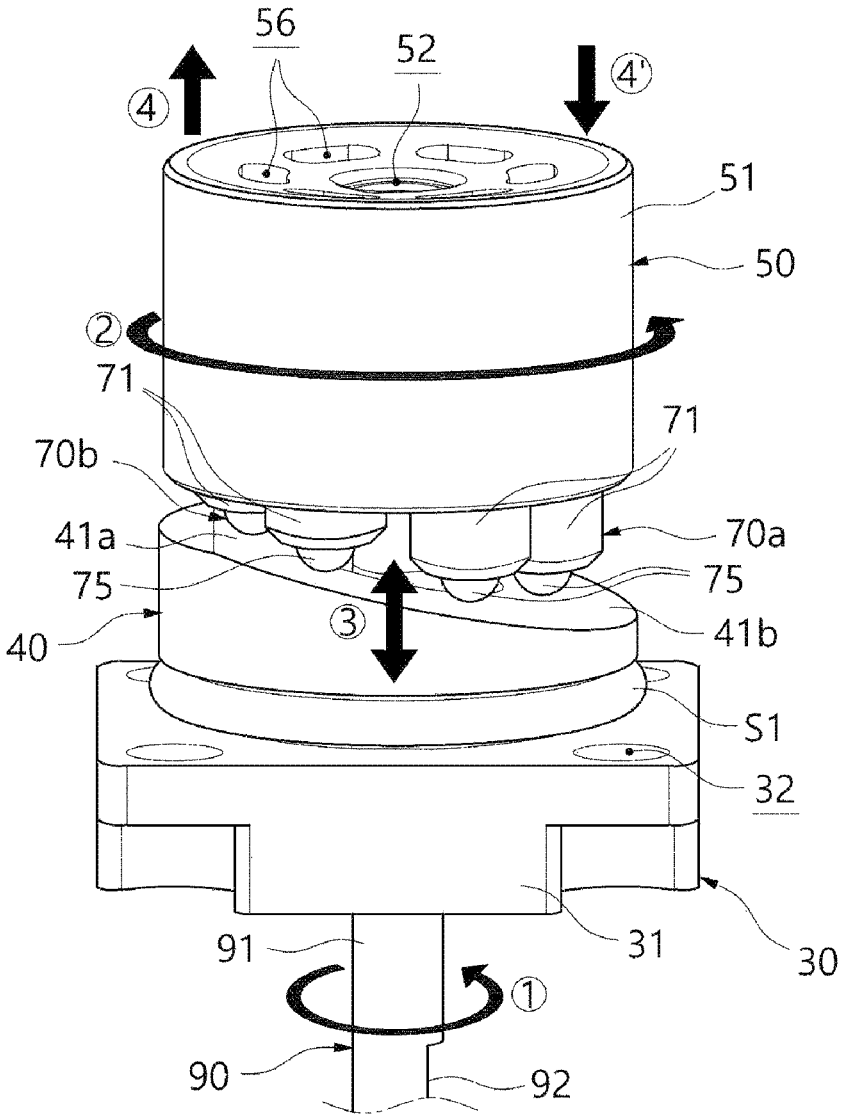
FIG. 6 is a perspective view showing the internal configuration with a housing removed in FIG. 1.

FIG. 6 is a perspective view showing the internal configuration without the housing 10, 30 shown in FIG. 1. For reference, in FIG. 6, the top dead surface 41*a* of the inclined surface 41 of the swash plate 40 is at the left side and the bottom dead surface 41*b* is at the right side.

First, the driving shaft 90 is rotated by a motor that is a driver. When the driving shaft 90 is rotated in the direction of an arrow ①, the cylinder block 50 fixed to the driving shaft 90 is also rotated. The cylinder block 50 is rotated in the same direction as the driving shaft 90 and an arrow ② indicates the rotational direction of the cylinder block 50. The rotational axis of the cylinder block 50 is the driving shaft 90. However, since the lower housing 10, 30 and the swash plate 40 disposed on the housing are not coupled to the driving shaft 90, they remain fixed without rotating.

As the cylinder block 50 is rotated, the piston units 70 inserted in the cylinder block 50 are also revolved. Since at least a portion of the piston body 71 of the piston unit 70 is inserted in the cylinder room 55 of the cylinder block 50, when the cylinder block 50 is rotated, the piston unit 70 is correspondingly revolved. The piston units 70 inserted in the several cylinder rooms 55 are simultaneously revolved.

The piston units 70 are revolved with the piston balls 75 of the piston units 70 in contact with the inclined surface 41 of the swash plate 40. Since the piston ball 75 has a spherical shape, it reduces friction between the piston units 70 and the inclined surface 41 of the swash plate 40. The piston units 70 move up and down in the cylinder rooms 55 while revolving. The piston units 70 are moved up by the swash plate 40 when they are moved from the bottom dead surface 41*b* to the top dead surface 41*a*, and they are moved down when they are moved from the top dead surface 41*a* back to the bottom dead surface 41*b*.

Referring to FIG. 6, the piston unit 70 at the right side in the figure protrudes downward on the bottom dead surface 41*b*, but the piston unit 70 at the right side is in the cylinder room 55 on the top dead surface 41*a*. When the cylinder block 50 keeps rotating, the piston unit 70 at the left side protrudes toward the swash plate 40 while moving from the top dead surface 41*a* to the bottom dead surface 41*b*, and the piston unit 70 at the right side goes into the cylinder room 55 while moving from the bottom dead surface 41*b* to the top dead surface 41*a*. The piston units 70 are moved up and down while this process is continuously repeated. An arrow ③ indicates the up-down movement direction of the piston units 70.

While the piston units 70 are moved up and down, the working fluid in the cylinder room 55 is compressed and discharged, and suctioned from the outside. When the piston unit 70 at the left side compresses the working fluid in the cylinder room 55 while moving up, the compressed working fluid moves in the direction of an arrow ④ and is discharged into the first port 18*a*. Further, when the piston unit 70 at the right side moves downward and the pressure in the cylinder room 55 decreases, working fluid is suctioned into the cylinder room 55 through the second port 18*b* from the outside and is prepared to be compressed.

When the piston units 70 are moved to the bottom dead surface 41*b*, the piston units 70 should be pushed toward the swash plate 40, and the elastic members 80 perform this function.

The elastic member 80 is in close contact with the top of the piston unit 70 and provides elasticity that pushes the piston unit 70 down, that is, toward the swash plate 40. Further, the elastic member 80 has another function of reducing the volume of the fluid space 83 by being compressed, thereby discharging the working fluid to outside.

Referring to FIG. 7, the volume of the fluid space 83 of the elastic member 80 disposed over the piston unit 70 at the right side is relatively large, the piston unit 70 has protruded toward the swash plate 40, and the internal pressure has been decreased, so working fluid is suctioned from the outside. Further, the volume of the fluid space 83 of the elastic member 80 disposed over the piston unit 70 at the left side is relatively small, the piston unit 70 is moved upward, and the internal pressure increases, so the working fluid is discharged in this process.

Figure 8:
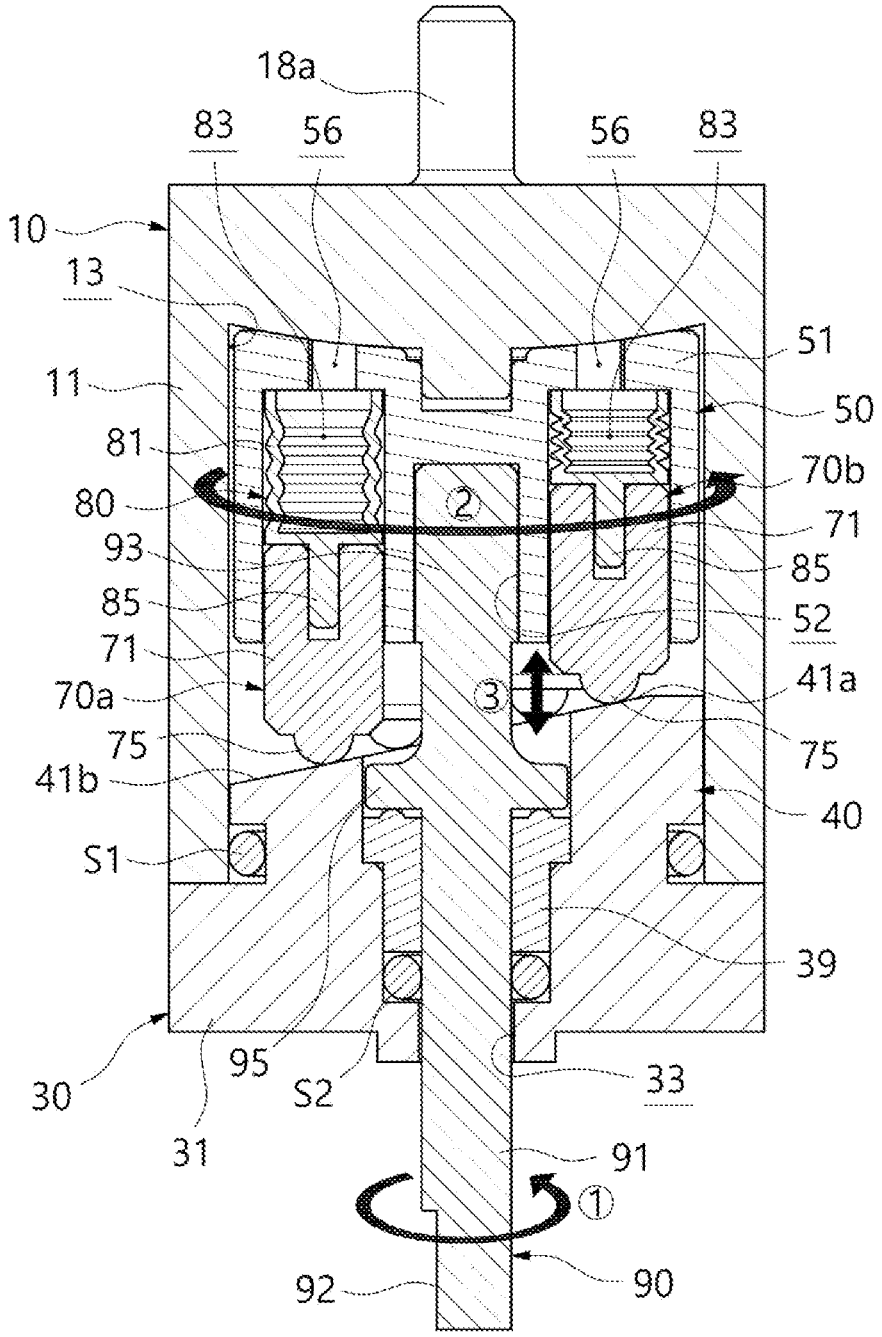
FIG. 8 is a cross-sectional view showing the state in which a cylinder block has rotated and piston units have revolved in FIG. 7.

In this state, when the cylinder block 50 keeps rotating, the piston unit 70 at the left side moves to the bottom dead surface 41*b* and protrudes toward the swash plate 40, and in this process, the pressure of the fluid space 83 decreases and working fluid is received from the outside. FIG. 8 shows the state in which the cylinder block 50 has rotated 180 degrees from the state shown in FIG. 7. As shown in the drawing, the swash plate 40 remains at the position, but, due to rotation of the cylinder block 50, the piston unit 70 that was at the left side is positioned on the bottom dead surface 41*b* by moving right and the piston unit 70 that was at the right side is positioned on the top dead surface 41*a* by moving left.

When a piston unit 70 moves to the bottom dead surface 41*b*, the elastic member 80 is naturally elastically restored, so the fluid space 83 increases. The elastic member 80, as describe above, has a prominences and depressions on the outer side and the prominences and depressions are continuously formed in the compression direction of the elastic member 80, thereby forming a corrugated pipe shape. Accordingly, when the elastic member 80 is compressed, the corrugated pipe is deformed such that the gaps between the prominences and recessions decrease, whereby it can have large elastic restoration force.

Further, since the elastic member 80 prevents leakage of working fluid by operating as a kind of sealing member, thereby remaining the working fluid only in the fluid space 83. Referring to FIG. 7, it can be seen that the upper end 82 of the elastic member 80 has a predetermined height by extending in the longitudinal direction of the cylinder room 55 to improve the sealing function and guide a compressive direction.

Such a sequential operation is continuously performed with rotation of the cylinder block 50 and revolution of the piston units 70, and in this process, suction and discharge are repeated. In this process, the piston units 70 move up and down with revolution and there is no retainer for connecting the piston units 70 and the swash plate 40 to each other, so there is no operation that a retainer pulls a piston unit 70 toward the swash plate 40. Accordingly, there is no excessive external force that is applied between a retainer and a piston unit 70, so it is possible to prevent damage to the pump or deterioration of the efficiency during the operation.

On the other hand, the first port 18*a* or the second port 18*b* of the housing 10, 30 may be changed into an inlet or an outlet for fluid, depending on the rotational direction of the driving shaft 90. That is, if external force that is applied in one direction is generated when the cylinder block 50 is rotated clockwise, external force can be generate din the opposite direction when the cylinder block 50 is rotated counterclockwise. For example, a hydraulic cylinder connected to the pump can be operated in two directions. This is an advantage that can be obtained by fixing the swash plate 40 and rotating the cylinder block 50, and there is an advantage that it is possible to simply change the generation direction of hydraulic pressure by changing the rotational direction of the driving shaft 90.

Even if all components of the embodiments of the present invention were described as being combined in a single unit or operated in combination with each other, the present invention is not limited to the embodiments. That is, the all components may be selectively combined and operated within the scope of the present invention. Further, the terms "comprise", "include", "have", etc. when used in this specification mean that the components can exist inside unless specifically stated otherwise, so they should be construed as being able to further include other components. Unless otherwise defined, all terms including technical and scientific terms used herein have the same meaning as commonly understood by those skilled in the art to which the present invention belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

The above description merely explains the spirit of the present invention and the present invention may be changed and modified in various ways without departing from the spirit of the present invention by those skilled in the art. Accordingly, the embodiments described herein are provided merely not to limit, but to explain the spirit of the present invention, and the spirit of the present invention is not limited by the embodiments. The protective range of the present invention should be construed by the following claims and the scope and spirit of the present invention should be construed as being included in the patent right of the present invention.

What is claimed is:

1. A fluid pump, comprising:

a housing having an operation space and having connection ports disposed at a side in the operation space to discharge a working fluid and suction the working fluid from an outside;

a swash plate coupled to the housing at an opposite side to the connection ports and having an inclined surface on a top facing the operation space;

a cylinder block disposed in the operation space to be rotated by a driving shaft and having a plurality of cylinder rooms therein that extend in parallel with the driving shaft;

a plurality of piston units inserted at least partially in the respective plurality of cylinder rooms to revolve with the cylinder block and compressing or suctioning the working fluid while moving up and down on the inclined surface of the swash plate with each of the plurality of piston units having one protruding end thereof in contact with the inclined surface of the swash plate; and a plurality of elastic members coupled to respective upper portions of the plurality of piston units that face the connection ports, and elastically supporting the respective plurality of piston units toward the swash plate, wherein each of the plurality of piston units comprises:

a piston body extending in an up-down movement direction of the respective piston unit; and a piston ball having a curved outer shape and connected to the one protruding end of the piston body, and wherein a coupling groove is formed on a top of the piston body that is opposite to the piston ball, such that a coupling protrusion of the respective elastic member is fitted in the coupling groove so the top of the piston body and the respective elastic member are in close contact with each other.

2. The fluid pump of claim 1, wherein each of the plurality of elastic members defines a fluid space, has an end being open toward the connection ports, is compressed to reduce a volume of the fluid space when the respective piston unit is moved up on the swash plate, and is elastically restored to increase the volume of the fluid space when the respective piston unit is moved down on the swash plate.

3. The fluid pump of claim 2, wherein each of the plurality of elastic members has prominences and depressions on an outer surface and the prominences and depressions are continuously formed in a compression direction of the respective elastic member to form a corrugated pipe shape.

4. The fluid pump of claim 1, wherein the piston ball of the respective piston unit is integrally formed with the piston body or the piston ball is coupled to the piston body.

5. A fluid pump, comprising:

a housing having an operation space and having connection ports disposed at a side in the operation space to discharge a working fluid and suctioning the working fluid from an outside;

a swash plate coupled to the housing at an opposite side to the connection ports and having an inclined surface on a top facing the operation space;

a cylinder block disposed in the operation space to be rotated by a driving shaft and having a plurality of cylinder rooms therein that extend in parallel with the driving shaft;

a plurality of piston units inserted at least partially in the respective plurality of cylinder rooms to revolve with the cylinder block and compressing or suctioning the working fluid while moving up and down on the inclined surface of the swash plate with each of the plurality of piston units having one protruding end thereof in contact with the inclined surface of the swash plate; and a plurality of elastic members coupled to respective upper portions of the plurality of piston units that face the connection ports, and elastically supporting the respective plurality of piston units toward the swash plate, wherein each of the plurality of elastic members comprises:

an upper end disposed at an upper portion facing the connection ports and having an inlet of a fluid space;

a lower end disposed opposite to the upper end and being in close contact with the top of the piston body of the respective piston unit; and a compressive body connecting the upper and the lower ends to each other and configured to change the volume of the fluid space in the respective elastic member by being compressed or restored, and wherein an outer diameter of the upper end of each of the plurality of elastic members is larger than or equal to an inner diameter of the respective cylinder rooms, so a side of the end is in close contact with an inner side of the respective cylinder room, and an outer diameter of the compressive body of the respective elastic member is smaller than the inner diameter of the respective cylinder room.

6. The fluid pump of claim 5, wherein the upper end of each of the plurality of elastic members has a predetermined height by extending in a longitudinal direction of the respective cylinder room.

* * * * *